US005198859A

United States Patent [19]

Soma et al.

[11] Patent Number: 5,198,859

[45] Date of Patent: Mar. 30, 1993

[54] DOCUMENT INFORMATION DETECTING DEVICE FOR A COPYING MACHINE

[75] Inventors: Utami Soma; Kazumichi Yamauchi, both of Hachioji, Japan

[73] Assignee: Konica Corporation, Tokyo, Japan

[21] Appl. No.: 713,114

[22] Filed: Jun. 10, 1991

[30] Foreign Application Priority Data

Jun. 13, 1990 [JP] Japan ..... 2-154468
Jul. 6, 1990 [JP] Japan ..... 2-178807

[51] Int. Cl.[5] ..... G03G 15/00

[52] U.S. Cl. ..... 355/204; 355/311; 355/75

[58] Field of Search ..... 355/203, 208, 311, 75, 355/204, 231, 233

[56] References Cited

U.S. PATENT DOCUMENTS 4,222,105 9/1980 Shimizu et al. ..... 355/204 X
4,372,674 2/1983 Yukawa et al. ..... 355/208
4,456,372 6/1984 Yamauchi ..... 355/75
4,474,453 10/1984 Yanagawa et al. ..... 355/311 X
4,673,282 6/1987 Sogame ..... 355/208 X
5,032,867 7/1991 Nagata et al. ..... 353/311 X

FOREIGN PATENT DOCUMENTS 43-16199 7/1968 Japan .
53-93834 8/1978 Japan .
56-22424 3/1981 Japan .
57-45564 3/1982 Japan .
60-21041 2/1985 Japan ..... 355/311
63-46421 9/1988 Japan .

*Primary Examiner*—Joan H. Pendegrass
*Attorney, Agent, or Firm*—Frishauf, Holtz, Goodman & Woodward

[57] ABSTRACT

The invention provides an apparatus for detecting an image on a document for use in a copying machine. A scanner scans the document and photoelectrically reads the image to generate a first analog signal representing a size of the document and a second analog signal representing an image density of the image. A central processing unit processes the first and second analog signals to determine the size and the image density of the document. The central processing unit includes an input port for receiving both of the first and second analog signals and a switch for selectively inputting one of the first and second analog signals at a time into the input port.

4 Claims, 8 Drawing Sheets

DOCUMENT INFORMATION DETECTING DEVICE FOR A COPYING MACHINE

BACKGROUND OF THE INVENTION

The present invention relates to a document information detecting apparatus having a document size detection means and a document density detection means, for use in a copying machine forming images with an electrophotographic system.

Located around a revolving image-carrier in a copying machine of an electrophotographic type are a charging means such as a corona charger, an exposure means for illuminating light images and thereby forming latent images, a charge-neutralizing means wherein an LED is used for illumination for forming an image frame, a developing means for developing the latent images to form toner images, a transfer means for transferring the toner images onto a recording sheet and a cleaning means for removing toners remaining on the image-carrier after transferring of the toner images onto the recording sheet has occured.

With regard to the developing means, when it is a developing unit employing developers of a two-component type, carriers and toners are agitated fully in a developer container to become developers wherein toners are attracted triboelectrically onto carriers. The developer are attracted magnetically to a developing sleeve to form a layer around it and are transported to the developing area which faces the image carrier. Latent images on the image-carrier are developed by developers in the developing area into visible images (toner images) in which toners are attracted electrostatically to the latent image portions.

A technique to detect document density for automatic adjustment of image quality in the course of development has been proposed in Japanese Patent Publication Open to Public Inspection No. 93834/1978 (hereinafter referred to Japanese Patent O.P.I. Publication). In addition to that, a technique for charging a bias voltage on a developing roller depending on the background color of a document and the level of image density on the document to thereby automatically adjust the density of a copy image has been proposed in Japanese Patent O.P.I. Publication No. 45564/1982.

When toners are consumed in the course of development and thereby the toner ratio in the developer is lowered to a level that is equal to or lower than the lower limit of a certain range, satisfactory toner images may not be obtained. The occurence of this situation needs to be detected, and then toners need to be replenished into the developing unit promptly. This technique is disclosed in Japanese Patent Examined Publication Nos. 16199/1968 and 46421/1988. With this technique, an electrostatic latent image of a reference patch image having a preset density is formed at a location on a photoreceptor drum which does not come in contact with a recording sheet. Then, this latent image is developed, and the density of the toner image of the reference patch image thus obtained is examined by a photoelectric sensor. When the density of the toner image of the reference patch is lower than a certain preset value, the concentration of toners in the developing unit is determined to be inadequate, and toners are replenished accordingly into the developing unit from a hopper. When the density of the toner image is satisfactory, on the other hand, toners are not replenished. Thus, the density of images formed on a recording sheet can be kept equal to or higher than a certain level.

Further, Japanese Patent O.P.I. Publication No. 22424/1981 discloses a device wherein the reverse side of a document cover (a platen cover) with which a document on a platen glass is brought in contact is provided with a colored portion which is covered partially or entirely by the document so that the document size can be detected.

Heretofore, a copying machine has been equipped with a document size detecting means (called an APS device hereinafter) an image density detecting means (called on EE device hereinafter) and a toner rate detecting means, and thereby automatic size selection and feeding of recording sheets, copy density adjustment and replenishment of toners into a developer have been carried out. For the control of the above-mentioned functions, a central processing unit (CPU) composed of an LSI integrated circuit has been used.

Recently, there is available a CPU having an analog inputting mode wherein analog signals can be processed inside the CPU. Thus, small-sized and inexpensive control devices are attained.

However, as a CPU generally available is provided with a limited number of input ports for analog signals, such CPU is insufficient for a copying machine having many analog signals to be processed through analog input ports. In case of a copying machine, therefore, the analog signals are processed to be converted into digital signals externally outside of a CPU. Therefore, an IC for processing analog signals needs to be added, requiring an additional space and causing a device to be expensive, which has been a problem.

The first object of the invention is to provide a document information detecting device for a copying machine wherein above-described problems may be solved and a CPU having input ports for analog signals fewer in number than normally required for a copying machine can also be used.

In the device mentioned above, many sensors have been used as various types of detecting means, and circuits for each of such sensors have been needed, causing the device to be complicated in structure and to be expensive.

The second object of the invention is to provide a relatively inexpensive copying apparatus wherein one set of sensors can serve two different functions, less adjustment is needed in assembly work, and the number of necessary parts is reduced.

SUMMARY OF THE INVENTION

The above-described first object can be attained by a document information detecting device for a copying machine wherein document size signals detected by a document size detecting means and document density signals detected by a document density detecting means are received by a CPU having an analog input mode, and then are processed therein to determine document size and document density. The above-described document size signals and document density signals are inputted in the same analog input port of the above-mentioned CPU and are processed alternatively.

The above-described second object can be attained by a document information detecting device for a copying machine wherein an automatic document size detecting means detects document size with output signals of a plurality of optical sensors each having its own wavelength for the highest sensitivity, and an automatic document density detecting means detects document density with signals from the optical sensors. One of the above-described plural optical sensors for automatic document size detection is used also as the optical sensor of the automatic document density detecting means.

DETAILED DESCRIPTION OF THE PREFERRED EMBODIMENT

Figure 1:
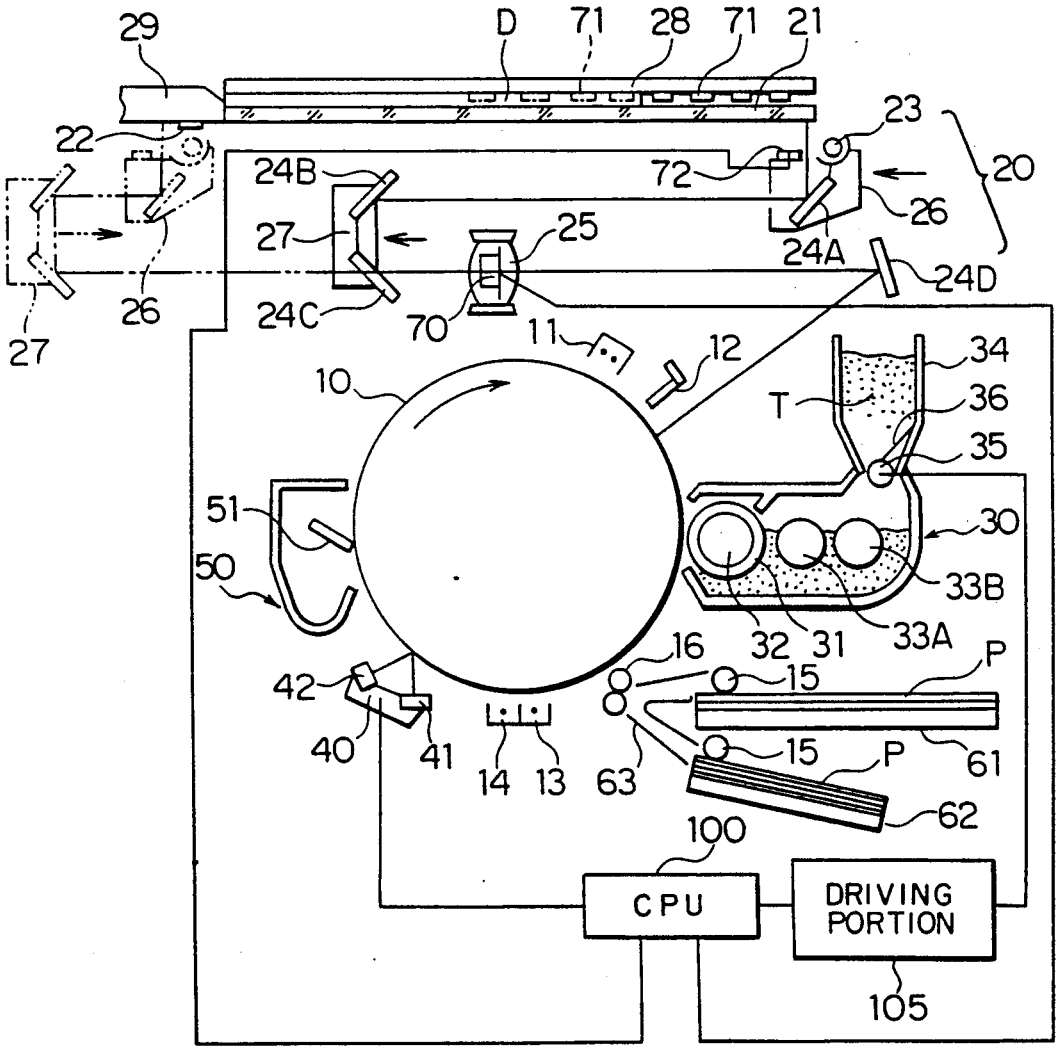
FIG. 1 represent a sectional view a copying machine constructed in accordance with the invention for attaining the first object of the invention.

In FIG. 1, the numeral 10 is a photoreceptor drum that is an image-carrier rotating in the arrowed direction (clockwise) around which are provided charging unit 11, charge-neutralizing unit 12, developing unit 30, transferring unit 13, separating unit 14, toner sensor 40 which is an optical density detecting means, and cleaning unit 50.

Provided on the top of the copying machine, are document stand 21 consisting of a transparent glass plate or the like, document cover 28 marked, on its reverse side, with a plurality of colored stripes 71, and scale plate 29 indicating the position for placing a document according to its size. Colored stripes 71 are marked for the detection of document size in a pattern of stripes arranged in parallel on the reverse side of the document cover 28 with proper intervals depending on detection sizes in the direction making a right angle with a scanning direction which will be mentioned later. The color yellow is preferably used for stripes 71 because it hardly forms a latent image on an ordinary copying machine. Provided on the reverse side of the scale plate 29 is reference patch 22 having a standard preset density for detecting toner rate information.

Provided under the document stand 21 and inside the copying machine itself, is scanning optical system 20 which is composed of first mirror unit 26, second mirror unit 27, primary lens 25 and EE sensor 70. The EE sensor 70 is a sensor provided on the side of primary lens 25 for obtaining document density detection signals. The first mirror unit 26 is equipped with mirror 24A, exposure lamp 23 and APS sensor 72, and is so arranged that it can travel straight between left and right sides in the figure and in parallel with the above-described document stand 21 for scanning colored stripes 71, reference patch 22 and the entire surface of document D (see FIG. 2). The second mirror unit 27 wherein mirror 24B and mirror 24C are provided integrally travels straight in parallel with document stand 21 in the same direction as the first mirror unit 26 at a speed that is half of the speed of the first mirror unit 26.

The above-described APS sensor 72 is a sensor for obtaining document size detection signals, which is composed of monochromatic sensor 72*a* and color sensor 72*b*. The monochromatic sensor 72*a* has a flat spectral sensitivity or a spectral sensitivity which is close to the relative wide range spectral sensitivity. When colored stripe 71 is yellow, a sensor having sensitivity for blue is used for color sensor 72*b*, because blue is complementary color of yellow.

The numeral 100 is a CPU for controlling the entire copying machine, and 105 is a driving unit which drives, under control of the CPU 100, the toner replenishing roller 35 which will be described later.

Figure 3:
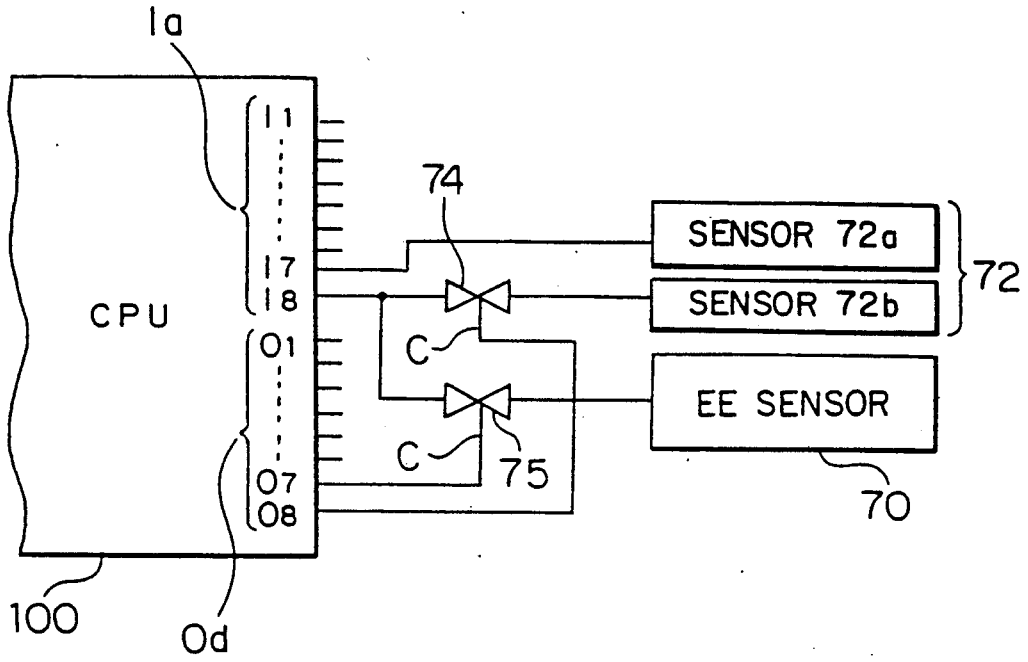
FIG. 3 is a circuit diagram showing how CPU 100 in FIG. 1 is connected to APS sensor 72 and to EE sensor 70.

In FIG. 3, the symbol Ia represents analog input ports of CPU 100, the symbol Od represents digital output ports, 74 and 75 represent an analog input switch and c is its control terminal. The analog input switches 74, 75 are composed of I.C. and the like. One of analog input ports Ia of CPU 100, such as $I_7$, for example, is connected directly to the output terminal of monochromatic sensor 72*a* of APS sensor 72, and another one of analog input ports Ia, $I_8$, for example, is connected both to an output terminal of color sensor 72*b* through analog input switch 74 and to an output terminal of EE sensor 70 through analog input switch 75. Control terminal c of analog input switch 74 is connected to one of digital output ports Od of CPU 100 and control terminal c of analog input switch 75 is connected to another one of the digital output ports Od, such as $O_8$, for example.

Figure 2:
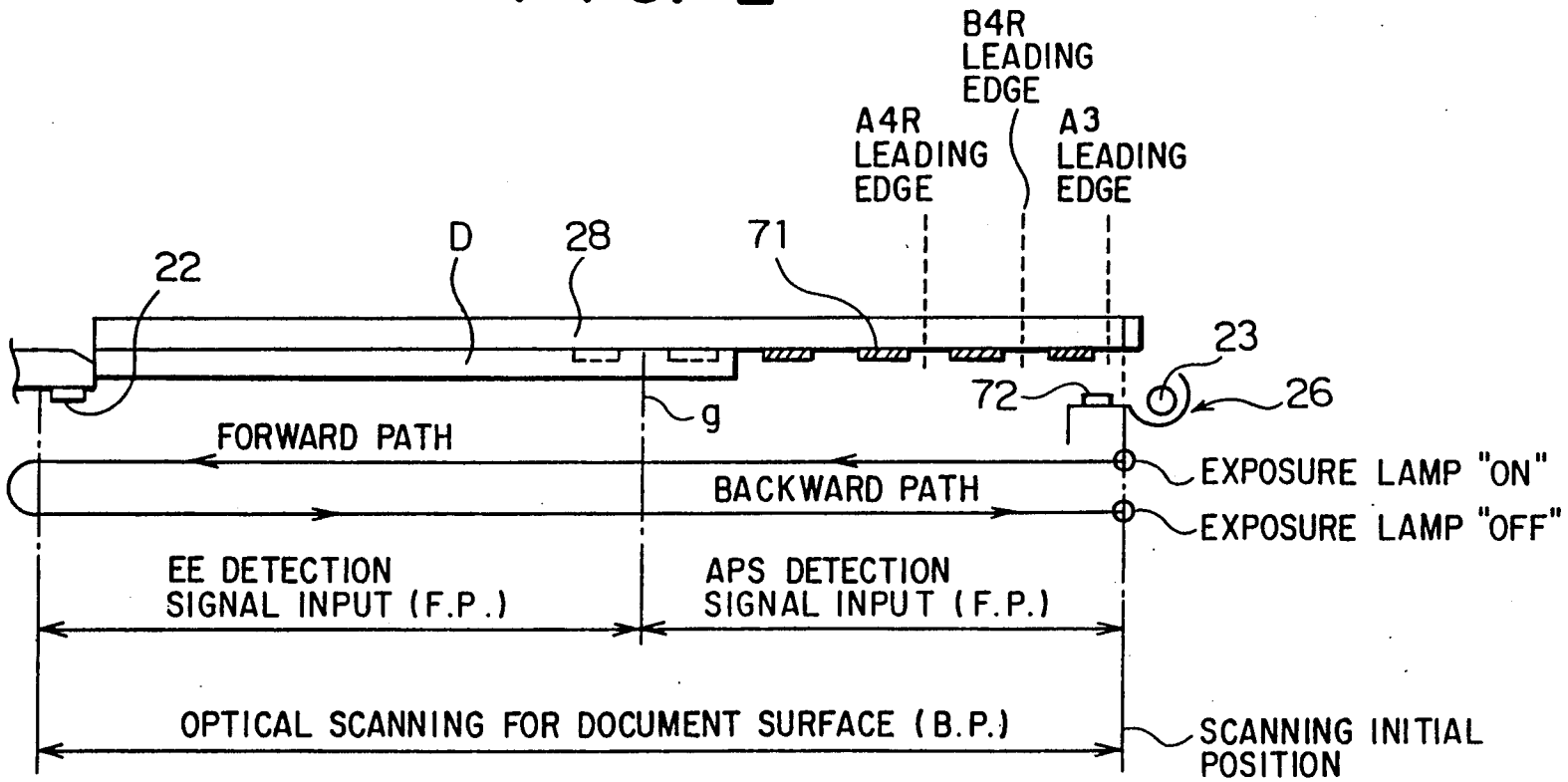
FIG. 2 is a view similar to FIG. 1 but showing only the components associated with document cover 28, mirror unit 26, and the motion followed by mirror unit 26.

In the present example, an initial position of scanning for the first mirror unit 26 is, as shown in FIGS. 1 and 2, at the right end of document stand 21, and when an copy button (not shown) is pressed and command signals for copying are inputted to CPU 100, the following operations are conducted under the control of CPU 100.

Figure 4:
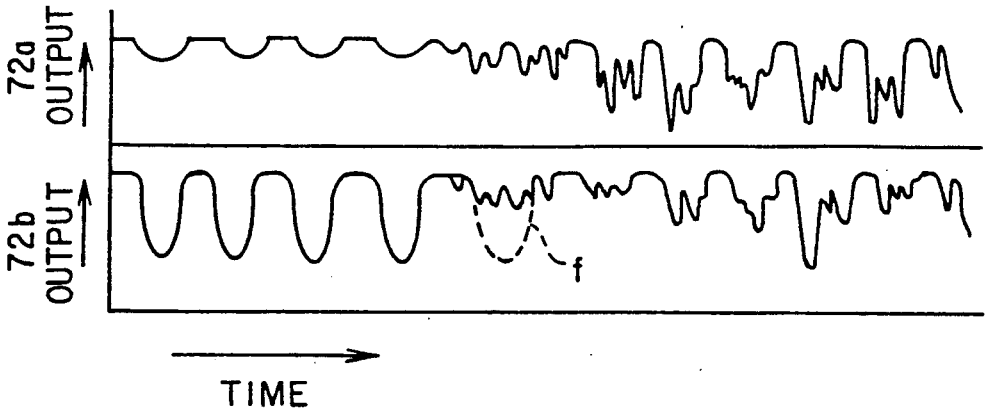
FIG. 4 is a graph showing an example of an output of the APS sensor 72 shown in FIG. 1.
Figure 8:
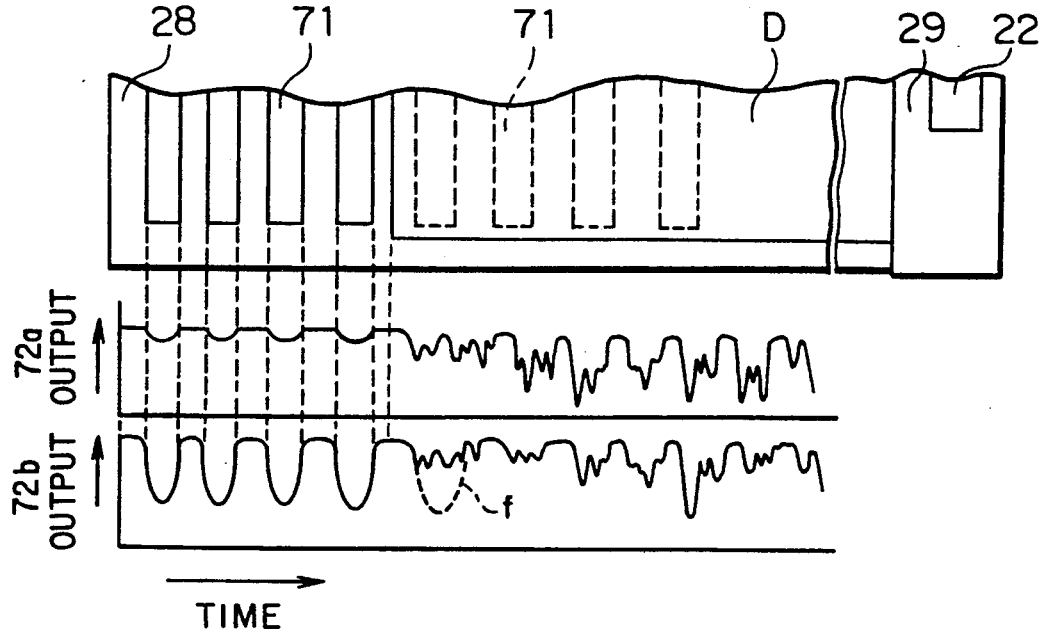
FIG. 8 is a graph showing an example of an output from APS sensor 72 in FIG. 5 juxtaposed with a plane view of document cover 28 and document D, and FIG. 9, consisting of FIGS. 9A and 9B, is a flow chart showing an example of process for determining bias voltage to be applied on a developing sleeve in FIG. 5.

First, exposure lamp 23 is lit, the first mirror unit 26 and the second mirror unit 27 of scanning optical system 20 travel to the left in the figure, and APS sensor 72 and EE sensor 70 start detecting colored stripes 71 on the reverse side of document cover 28 and an image on the image surface of document D. At this initial stage of operation, digital output port $O_7$ of CPU 100 is set to L level and digital output port $O_8$ is set to H level. Therefore, analog input switch 74 is in a conductive state and analog input switch 75 is in a high resistance state. Accordingly, output signals of color sensor 72*b* of APS sensor 72 are inputted to analog input port $I_8$. Examples of output signal waveforms of both monochromatic sensor 72*a* of APS sensor and color sensor 72*b* are shown in FIGS. 4, 8, and when the difference in output signal level between them is extracted, even color stripes 71 of less clear color such as yellow can surely be detected. Because a relatively large change occurs at a portion of the stripes 71.

When the first mirror unit 26 travels further along its path and thereby APS sensor 72 arrives at document D, both waveforms become similar to each other, and the large change in the level difference caused by colored stripes 71 does not appear at a location where a stripe 71 is marked so as to cause the large change to appear (dashed line f in FIG. 4). Then CPU 100 switches digital output port $O_7$ to H level and $O_8$ to L level. Accordingly, from this time (point g in FIG. 2), output signals of EE sensor 70 are inputted into analog input port $I_8$ of CPU 100. Document density detection signals representing average density of images of document D and density distribution are inputted into analog input port $I_8$ of CPU 100. Thus, CPU 100 processes detection signals received from APS sensor 72 of optical scanning system during a portion of its forward scanning path. CPU 100 determines from document size detection signals coming from APS sensor 72, a document size to be A3 size when none of colored stripes 71 is detected and to be A4R size when two of the stripes are detected, selects sheet-feed cassette holding recording sheet P whose size corresponds to the determined size to be necessary for copying operation to be started next, and indicates on a display unit (not shown) the size of the sheet to be fed. In addition, CPU 100 sets, using document density detection signals from EE sensor 70, a bias voltage suitable to images on document D to be applied to the developing sleeve 31.

Aforesaid density information detection for document D by EE sensor 70 is conducted for a region excluding a leading portion of document D which may correspond to a margin portion. However, there is no problem because density information on the leading portion of document D is not important.

When scanning optical system 20 reaches the end of its forward path (location shown by a two-dot chain line in FIG. 1), CPU 100 causes reversal of the first mirror unit 26 and the second mirror unit 27. Simultaneously, photoreceptor drum 10 is caused to rotate in the arrowed direction. In this backward motion scanning on an image surface of document D is conducted by primary lens 25. An image of reference patch 22 and images on document D placed on document stand 21 are reflected by above-mentioned mirrors 24A, 24B and 24C and further reflected by mirror 24D through primary lens 25, to be focused on photoreceptor drum 10 that is an image-carrier.

As the photoreceptor drum 10 rotates, its surface is charged uniformly by charging unit 11 and passes through neutralizing unit 12. The neutralizing unit 12 neutralizes, under the control of CPU 100, the frame areas outside of an image area excluding a portion to form a latent image of above-described reference patch through illumination by means of an I,ED. Due to the incident light from scanning optical system 20, electrostatic latent images corresponding to document D and reference patch 22 are formed on photoreceptor drum 10.

Two-component developers contained in developing unit 30 are agitated by agitating screws 33A and 33B and then attracted onto the external surface of developing sleeve 31 that rotates outside of magnet roller 32, thereby forming a magnetic brush. Thus, development is carried out at the developing area facing the photoreceptor drum 10 by developing sleeve 31 to which the aforesaid set bias voltage is applied. To be concrete, the electrostatic latent images of document D and reference patch 22 formed on photoreceptor drum 10 are developed by developing unit 30 to be visible images.

From one of sheet-feed cassette 61 or 62 selected on the basis of the information from the APS sensor, recording sheets are fed out one sheet at a time by first sheet-feed roller 15. The recording sheet P thus fed out passes through guide plate 63 and is fed out onto photoreceptor drum 10 by second sheet-feed roller 16 that runs in synchronization with toner images of document D formed on photoreceptor drum 10. Toner images not of reference patch 22 but of document D formed on photoreceptor drum 10 are transferred onto recording sheet P by transfer unit 13, and then recording sheet P is separated from photoreceptor drum 10 by separating unit 14. The recording sheet P onto which toner images have been transferred is fed by recording sheet conveying means (not shown) to fixing unit (not shown) where the toner images on the recording sheet are fused and fixed by a heat-fixing roller and a pressure roller. After that the recording sheet is ejected to the outside of a copying apparatus.

A toner image of reference patch 22 staying on the photoreceptor drum without being transferred onto recording sheet P arrives at toner sensor 40 composed of light emitting element 41 and light receiving element 42 which reads density of the toner image and inputs it into CPU 100. Inputted density detection signals of the toner image of the reference patch are compared with a reference value corresponding to the standard density, and if it is determined that the density is high and toner ratio is high (dark), nothing is done, but when judged that density is low and toner ratio is low (light), CPU 100 causes toner replenishing roller 35 to rotate for a predetermined time through driving portion 105 so that prescribed quantity of toner T in hopper 34 is replenished into developing unit 30. Toner replenishing roller 35 is provided on its surface, for example, with a plurality of grooves formed in parallel with an axis of the roller at a regular interval, and toners T in quantity proportional to the number of revolutions of the roller, or proportional to rotating time in case of constant speed of rotation (r.p.m.) can be replenished. Incidentally, 36 is a toner scraping plate which operates together with toner replenishing roller 35 and prevents occurence of poor toner supply caused by toner clogging.

The surface of photoreceptor drum 10 that rotates with a toner image of the reference patch and residual toners remaining after transferring in the image area is scraped by cleaning unit 50 equipped with blade 51 and cleaned for the following copy cycle. With regard to scanning optical system 20, when it arrives at the terminal point of the scanning backward path, that is, the original position for scanning, the exposure lamp 23 is put off for the following copy cycle.

As described above, in the document information detecting device of the invention, document size detection signals and document density detection signals are inputted alternately into the same input port as analog signals on a time sequence basis. Therefore, even a CPU having a limited number of analog input ports can be used efficiently without being modified, so that an inexpensive and small document information detection device for a copying machine can be provided.

Figure 5:
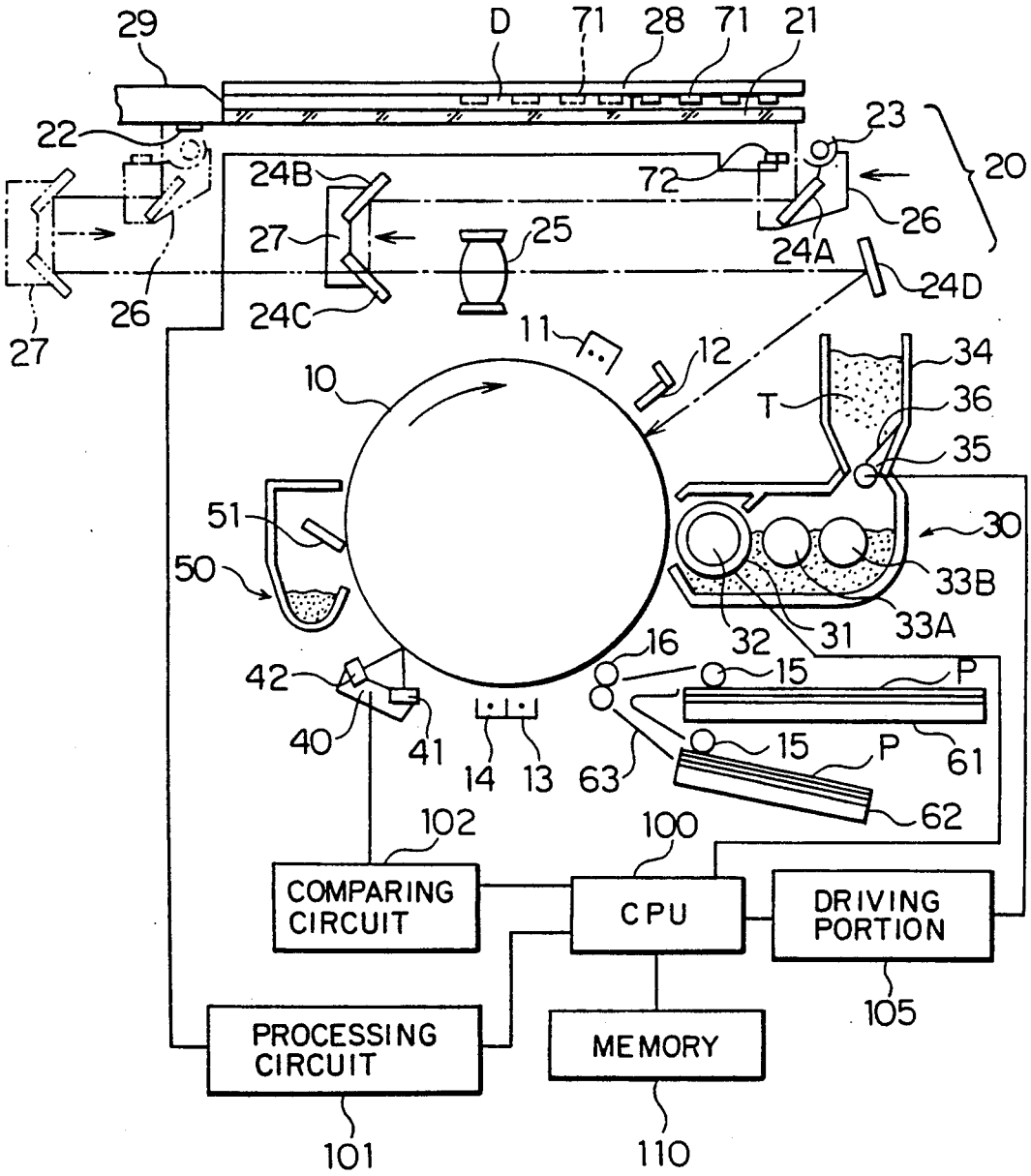
FIG. 5 is a sectional view of main portions of a copying apparatus constructed in accordance with the invention for attaining the second object of the invention.

An apparatus for achieving the second object of the invention will be explained next. FIG. 5 shows an example of a copying machine wherein parts and components that are the same as those of the copying machine shown in FIG. 1 are given the same symbols and their explanation will be omitted.

Figure 7:
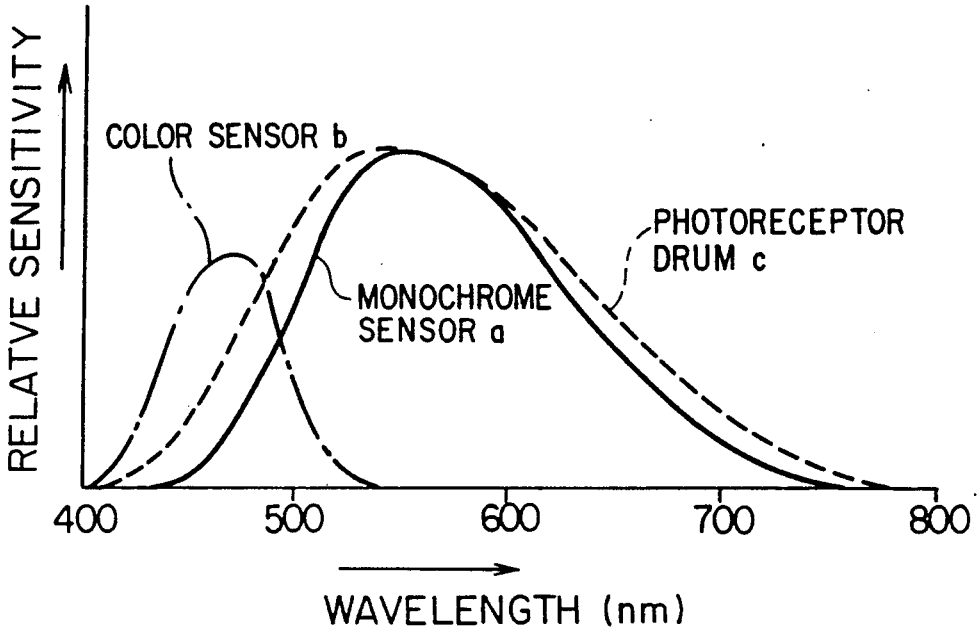
FIG. 7 is a graph showing an example of the output of APS sensor 72 shown in FIG. 5 and an example of a spectral sensitivity of a photosensitive layer on a photoreceptor drum.

APS sensor 72 in the present example is composed of two optical sensors for detecting document size and is additionally used for detecting document density. One of them is monochromatic sensor 72a having a relatively wide range spectral sensitivity or a spectral sensitivity that is close to common relative luminous efficiency, and the other is color sensor 72b in which a blue sensitive optical sensor is used when the color of stripes 71 is yellow, for example. FIG. 7 is a graph showing examples of spectral sensitivity in which the symbol "a" represents monochromatic sensor 72a, "b" represents color sensor 72b and "c" represents the spectral sensitivity of a photosensitive layer of photoreceptor drum 10. FIG. 8 shows examples of the output signals of monochromatic sensor 72a and of color sensor 72b both in APS sensor 72, and it is possible to reliably detect colored stripes 71 of an less clear color such as yellow, by taking the difference in signal level between the output signals of the monochromatic sensor 72a and that of the color sensor 72b.

Consumption of toners in a developer caused by copies depends on the average density of images on document D. Therefore, it is necessary to change, depending on the kinds of images on document D, a bias voltage to be applied on developing sleeve 31 for the purpose of maintaining copy density at an optimum value. For the document density detection signals to be used for setting the bias voltage, it is desirable to use output signals obtained from an optical sensor having a spectral sensitivity which is equal to that of a photosensitive layer on photoreceptor drum 10. However, it is generally difficult to make the spectral sensitivity of a single optical sensor used practically to be the same as that of photoreceptor drum 10. For obtaining better density information, therefore, it is preferable to use output signals from both monochromatic sensor 72a and color sensor 72b after adding the output signals at a certain ratio and amplifying them, rather than using density detection signals from only monochromatic sensor 72a of APS sensor 72. For example, when APS sensor 72 has a spectral sensitivity shown in FIG. 7, sensitivity of monochromatic sensor 72a is lower than that of photoreceptor at the wavelong the corresponding to blue color. Therefore, when the output signals from color sensor 72b are added at a certain ratio to compensate the difference in sensitivity, it is possible to make the spectral sensitivity close to that of a photosensitive layer on photoreceptor drum 10, so that an optimum bias voltage can be set. It may be possible, however, to use the output signals of monochromatic sensor 72a alone as the document density detection signals, after processing them in an amplifying circuit.

Figure 6:
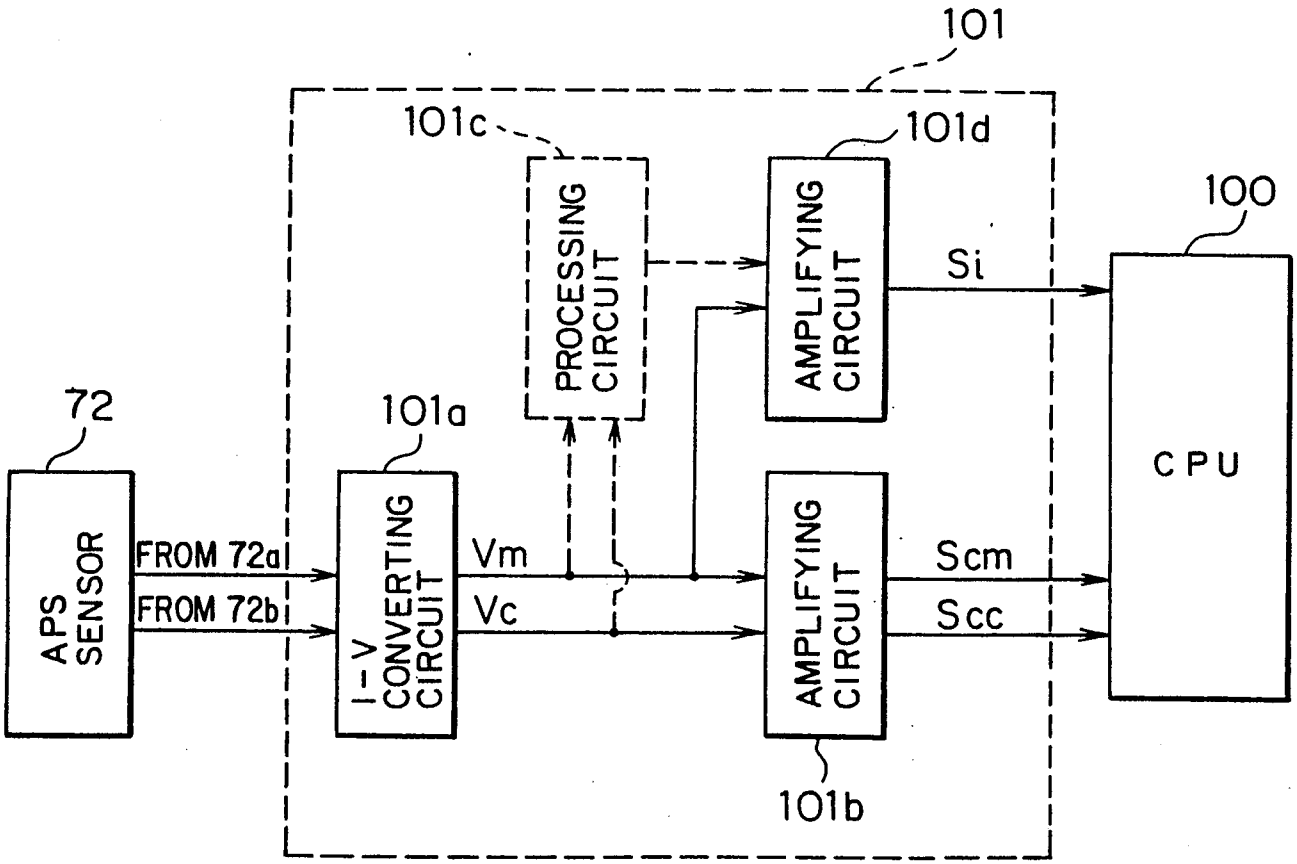
FIG. 6 is a block diagram showing an example of processing circuit 101 shown in FIG. 5.

FIG. 6 shows an example of a processing circuit, and the numeral 100 is a CPU that controls a copying apparatus entirely, 101 is a processing circuit that processes output signals of APS sensor 72 and sends document size detection signals and document density detection signals to CPU 100. CPU 100 determines developing bias voltage to be applied on developing sleeve 31 according, for example, to a flowchart shown in FIG. 9, depending on the document detection signals sent from the processing circuit 101.

In the processing circuit 101 in FIG. 6, the output signals from monochromatic sensor 72a and color sensor 72b both of APS sensor 72 are converted by I-V converting circuit 101a to voltage values of Vm and Vc, respectively and then are amplified in the amplifying circuit 101b to be document size detection signals Scm and Scc, respectively which are sent to CPU 100.

When monochromatic sensor 72a is used for document density detection, voltage signal Vm of monochromatic sensor 72a sent out from I-V converting circuit 101a is amplified by amplifying circuit 101d to be document density detection signals Si that are sent to CPU 100.

When the output signals from both monochromatic sensor 72a and color sensor 72b are used as document density detection signals Si, both voltage signals Vm and Vc are added at a certain ratio in processing circuit 101c as shown with a broken line, and then pass through amplifying circuit 101d as document density detection signals Si that are sent to CPU 100.

In the present example, an original point of the first mirror unit 26 for scanning is at the right end of document stand 21 as shown in FIG. 5, which is the same as shown FIG. 2, and when a copy button (not shown) is pressed and copy command signals are inputted in CPU 100, CPU 100 controls the copying machine to conduct the following operations.

First, exposure lamp 23 is lit, the first mirror unit 26 and the second mirror unit 27 of scanning optical system 20 travel to the left in the figure, and information detection by means of APS sensor 72 is started for colored stripes 71 on the reverse side of document cover 28 and for an image surface of document D. In this initial stage, CPU 100 receives document size detection signals Scm and Scc from processing circuit 101 and does not receive document density signals Si.

When the first mirror unit 26 travels and thereby APS sensor 72 arrives at document D, waveforms of two document size detection signals Scm and Scc become similar to each other and thereby the output change caused by colored stripes 71 does not appear on the spot where the stripe 71 is marked to cause such output change to appear (broken line f in FIG. 8). Therefore, CPU 100 switches to receive document density detection signals Si representing document density information of average density and density distribution of images on document D. Thus, CPU 100 receives document size detection signals Scm and Scc in the initial stage of the scanning forward path of scanning optical system 20, and determines that the document size is A3 when none of colored stripes is detected, or A4R when two lines are detected, selects sheet-feed cassette holding recording sheets P having a size corresponding to the determined size necessary for copy operation to be started next, and indicates the size of the recording sheet on a display unit (not shown).

In the following stage of aforesaid scanning forward path, CPU 100 receives document density detection signals Si obtained from monochromatic sensor 72a or from both of monochromatic sensor 72a and color sensor 72b, and establishes bias voltage to be applied on developing sleeve 31 suitable for images on document D.

Document density information detection by means of above-described APS sensor 72 is conducted for the proper area of document D excluding its peripheral portions whose density information is not important, and thereby causes no problem.

Above-described document density detection signals Si are subjected to sampling, density discrimination and counting in the CPU 100, and thereby the spread of a histogram, the lightest density and an average density are calculated and the values of the spread of a histogram, the lightest density and the average density are stored in memory 110 for the time being.

Figures 9, 9A:
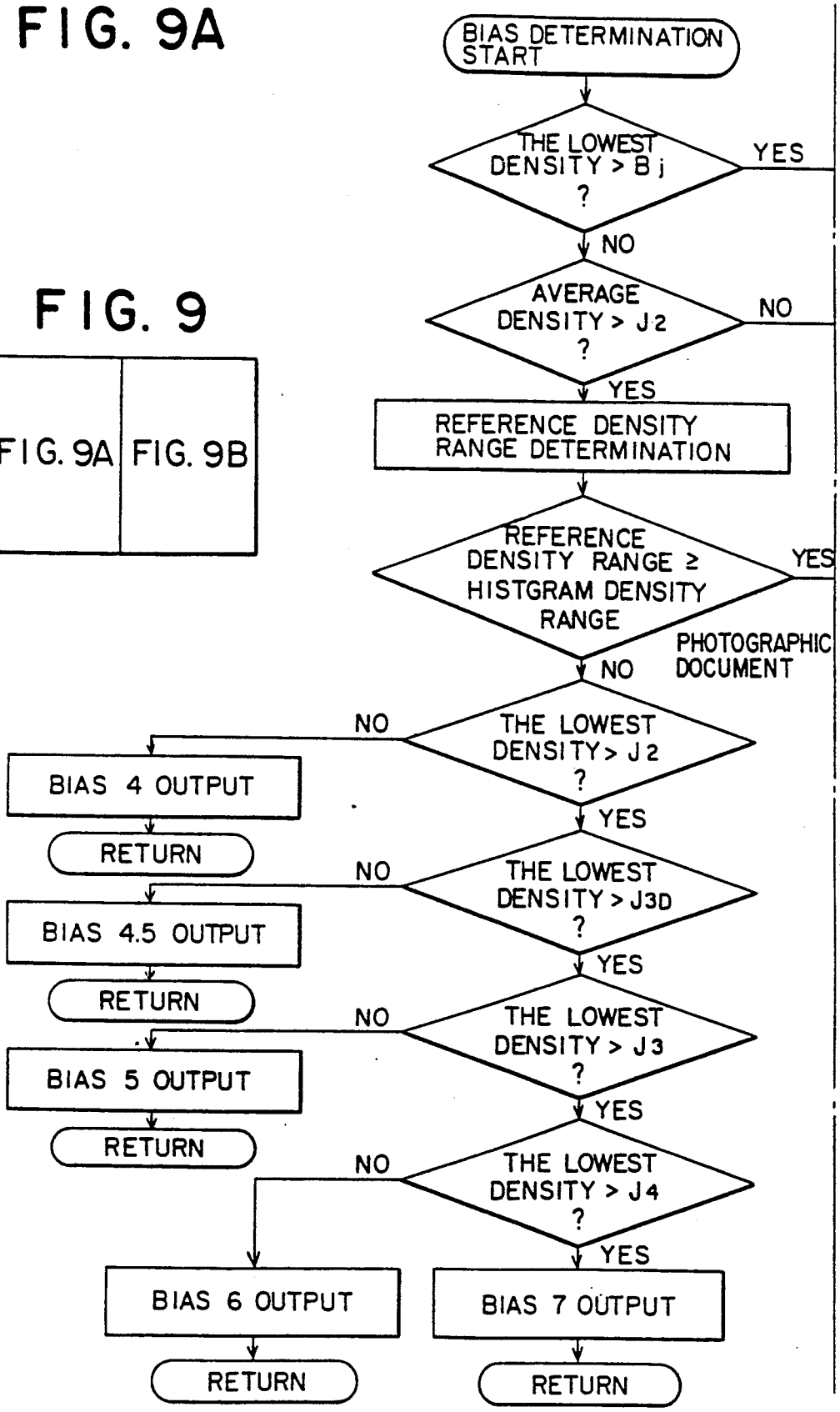
Figure 9B:
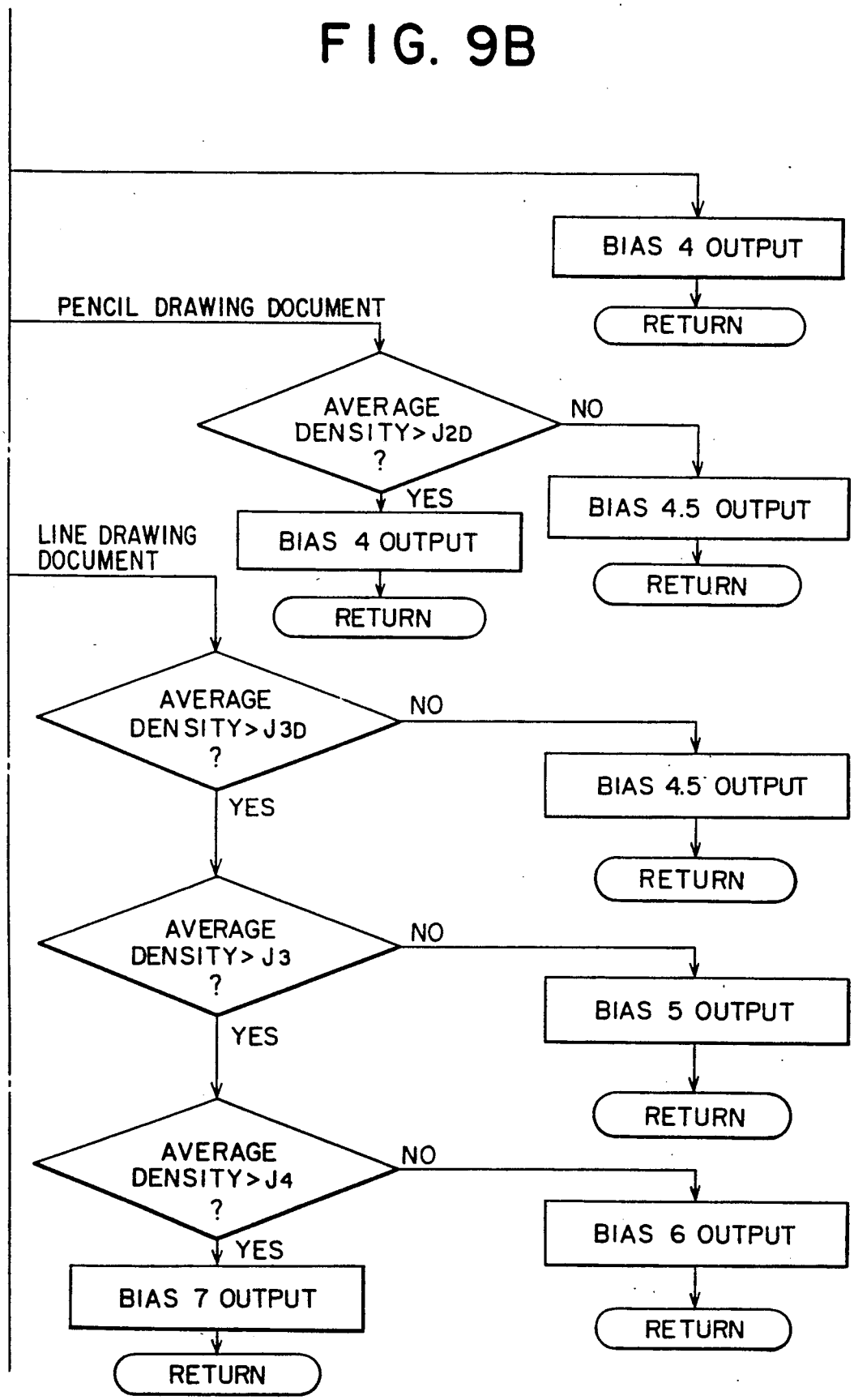

Before latent images on photoreceptor drum 10 are developed, the values of the average density of images on document D, the spread of a histogram and the lightest density are called by CPU 100 from the memory 110, thus CPU 100 discriminates the kind of document D and conducts setting of bias voltage to be applied on developing sleeve 31 according to the sequence shown, for example, in a flowchart in FIG. 9 in order to keep the copy density at a proper value. In the chart, Bj is a density level for determining the lightest density for discriminating a white background from a colored background, J2 is a density level for determining average density for discriminating an ordinary document from a photographic document, and each of J3 and J4 is a density level for determining proper bias voltage to obtain adequate density of a copy image, each of bias 4 to bias 7 represents a value of bias voltage to be applied on developing sleeve 31 in which the higher value represents the higher bias voltage.

CPU 100, at the terminal point of the scanning forward path of scanning optical system 20, causes reversal of the first mirror unit 26 and the second mirror unit 27, interrupts the receiving of document size detection signals Scm and Scc as well as document density detection signals Si, and initiate rotation of the photoreceptor drum 10 in the arrowed direction. In this backward motion, primary lens 25 scans an image surface of document D, and images on document D are formed successively on the photoreceptor drum 10 through mirror 24A, mirror 24B, mirror 24C, primary lens 25 and mirror 24D.

Incidentally, in the copying apparatus of the present example, when the density of a toner image of the reference patch is lower than the preset density, signals for replenishing toners are sent to CPU 100 from comparison circuit 101. CPU 100 which has received signals for replenishing toners calls the average density of document D from memory 110, and compares it with a specified density. When the average density is lower than the specified density, CPU 100 sets the toner replenishing time t to be short, for example 0.5 sec, because toner consumption will be small, while when the average density is higher than the specified density, the toner replenishing time is set to be long, for example 0.8 sec, because toner consumption will be high. After that, CPU 100 rotates toner replenishing roller 35 for t sec through driving section 105 so that the proper amount of toners in hopper 34 may be replenished into developing unit 30. The toner replenishing roller 35 is provided with, for example, a plurality of grooves which are arranged in parallel at regular intervals on its circumferential surface and may replenish toners T whose amount is proportional to the number of rotations, or to the rotating time in case of rotation at constant speed. Incidentally, the numeral 36 is a toner scraping-off plate which works together with toner replenishing roller 35, thus toner supply troubles caused by toner clogging are prevented.

A toner image of the reference patch after the density detection and the surface of photoreceptor drum 10 that rotates having thereon residual toners of image area after transferring are scraped off or scraped by cleaning unit 50 equipped with blade 51, for the following copy cycle.

Owing to the construction and operation control mentioned above, it is possible to eliminate a document density detecting sensor, in the copying apparatus of the invention, in which an output signal of one of plural optical sensors for automatic detection of document size, or an amplified signal combined by signals of plural optical sensors after adding them at a certain ratio is also used as document density detection signals. Therefore, it is possible to shorten the time required for adjustment of the copying machine, and to provide an inexpensive copying apparatus by reducing the number of parts thereof.

What is claimed is:

1. An apparatus for use in a copying machine which detects an image on a document, comprising:

a cover for setting said document onto a platen glass;

means for scanning a document and for photoelectrically reading said document along a given scan line and for reading both said document and a surface of said cover on said given scan line through said platen glass to detect a boundary line between said document and said cover surface for generating a first analog signal representing the size of said document and a second analog signal representing an image density of the image on said document;

a central processing unit having means for processing said first and second analog signals for determining the size of said document on the basis of the location of said boundary line on said given scan line, and the image density of said document, said central processing unit including:

an input port for receiving both of said first and second analog signals, and switch means for selectively inputting one of said first analog signal and said second analog signal at a time into said input port, wherein said scanning means scans said cover and said document in sequence, and wherein said switch means inputs said first analog signal and said second analog signal in sequence into said input port.

2. An apparatus for use in a copying machine which detects an image on a document, comprising:

a cover for setting said document onto a platen glass;

means for scanning a document and for photoelectrically reading said document along a given scan line and for reading both said document and a surface of said cover on said given scan line through said platen glass to detect a boundary line between said document and said cover surface for generating a first analog signal representing the size of said document and a second analog signal representing an image density of the image on said document;

a central processing unit having means for processing said first and second analog signals for determining the size of said document on the basis of the location of said boundary line on said given scan line, and the image density of said document, said central processing unit including:

an input port for receiving both of said first and second analog signals, and switch means for selectively inputting one of said first analog signal and said second analog signal at a time into said input port, wherein the surface of said cover is marked with a predetermined color to indicate said boundary line, said scanning means has two types of optical sensors having respective means for providing a different output signal depending on which color change at said boundary line is being detected.

3. The apparatus of claim 2, wherein the processing means processes said output signals from said two types of optical sensors to provide a control signal to actuate said switch after said scanning means have passed over said boundary line.

4. An apparatus for use in a copying machine, for detecting an image one a document which is placed on a platen glass and covered thereon with a cover, wherein a covering surface of said cover is marked with a predetermined color, comprising:

means for scanning both said document and said covering surface through said platen glass, said scanning means comprising a plurality of optical sensors differing in sensitive wavelength to output a plurality of color signals for indicating a color difference between said document and said covering surface;

a central processing unit having means for determining the size of said document on the basis of said color difference and for further determining the image density of said document on the basis of at least one of said plurality of color signals.

* * * * *